United States Patent [19]

Rodi et al.

[11] Patent Number: 4,761,594

[45] Date of Patent: Aug. 2, 1988

[54] DEVICE FOR DETECTING THE CONDITION OF CARBON BRUSHES

[75] Inventors: Anton Rodi, Leimen; Berthold Grützmacher, Dossenheim; Michael Krüger, Edingen-Neckarhausen, all of Fed. Rep. of Germany

[73] Assignee: Heidelberger Druckmaschinen AG, Heidelberg, Fed. Rep. of Germany

[21] Appl. No.: 840,377

[22] Filed: Mar. 17, 1986

[30] Foreign Application Priority Data

Mar. 15, 1985 [DE] Fed. Rep. of Germany ..... 3509299

[51] Int. Cl.[4] ..... H01R 39/58

[52] U.S. Cl. ..... 318/490; 310/242; 318/480

[58] Field of Search ..... 318/480, 490, 558, 491, 318/538, 541, 542; 310/229, 238, 239, 242, 245, 248, 240, 243, 244, 246, 249, 241

[56] References Cited

U.S. PATENT DOCUMENTS

| | | | |
|---|---|---|---|
| 3,523,288 | 8/1970 | Thompson | 310/239 X |
| 4,348,608 | 9/1982 | Michael | 310/242 |
| 4,356,395 | 10/1982 | Miller | 340/347 P X |

FOREIGN PATENT DOCUMENTS

| | | | |
|---|---|---|---|
| 57-43540 | 3/1982 | Japan | 310/238 |
| 57-101549 | 6/1982 | Japan | 310/242 |
| 58-49067 | 3/1983 | Japan | 310/239 |
| 59-106856 | 6/1984 | Japan | 310/248 |

*Primary Examiner*—Bentsu Ro

*Attorney, Agent, or Firm*—Herbert L. Lerner; Laurence A. Greenberg

[57] ABSTRACT

An optical device for detecting a condition of a carbon brush in a drive unit includes lightguides disposed in vicinity with the carbon brush yet out of contact with the carbon brush and having a device for monitoring wear of the carbon brush, and a device for triggering a warning signal when the carbon brush has reached a predetermined residual length.

6 Claims, 1 Drawing Sheet

DEVICE FOR DETECTING THE CONDITION OF CARBON BRUSHES

Figure 1:
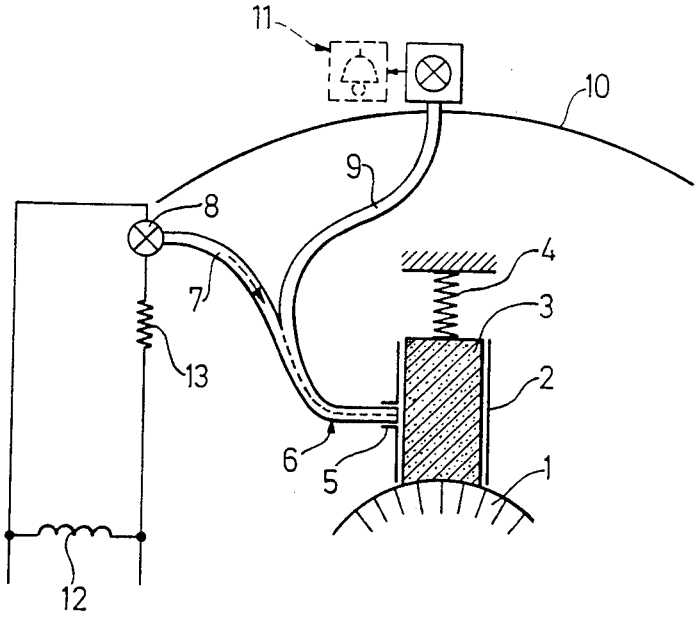

The invention relates to a device for detecting the condition of carbon brushes of drive units and, more particularly, drive units of printing presses.

Carbon brushes, which serve to supply current, for example, in commutator motors and DC machines, must be replaced before they are completely worn in order to protect commutators and slip rings, respectively, against damage. Because the operating life of carbon brushes depends, respectively, upon the type of operation and the environmental conditions of the installed motor, and it is desirable to utilize them to the maximum possible extent without any risk to the commutator, it is good practice to make a given level of wear of the carbon brushes visible outside of the drive unit or provide a signal for the operating and maintenance personnel, respectively, when a predetermined limit of wear has been reached.

So-called cut-off carbon brushes are known which automatically switch off the drive when the carbon brushes become worn. However, in the absence of expensive and time-consuming intermediate inspections, it is unforeseeable when the drive unit will be switched off and thus shut down with the result that undesired shut-down times which may occur at an undesired time, must forcibly be taken into consideration when such carbon brushes are used.

Carbon brushes with alarm devices which provide an early warning of the failure of carbon brushes due to wear are market-available. In this regard, an alarm contact is provided by a copper strand baked into the upper end of the carbon brush and by the commutator or slip ring. A disadvantage of such an alarm device is that the carbon brush, if possible, is not supposed to continue in operation for any considerably long period after the alarm has been given, because the copper strand may cause a disruption in the patina or damage to the commutator or slip ring body.

A different alarm or warning device from the same aforementioned firm is supposed to avoid this disadvantage be having the alarm contact occur via an auxiliary carbon brush which is formed of the same material as that of the main carbon brush and in which the copper strand is embedded by means of a cast resin insulating layer. Because the voltage of the armature circuit is not free of mains or supply network potential, the auxiliary carbon brush also carries the mains potential, which is why very involved and costly evaluation circuitry is required. If the insulation layer is worn through, the cast resin, depending on its composition and hardness, may leave undesirable smear traces or grooves on the commutator.

In addition, electrical brush monitoring systems have become known heretofore, for example, from the firm Contraves Motoren GmbH D-7880 Bad Säckingen, Federal Republic of Germary, which feature mechanical contacts which are applied to the carbon brush holder and are scanned by an electronic circuit and switch off the drive unit at a particular carbon-brush length. Apart from the circuitry required for evaluation purpcses, the contacts rubbing mechanically against the carbon brush or pressing thereon may impair the automatic forward feeding of the carbon brush, for example, due to jamming thereof or due to altering the characteristic curve of the compression spring and the like.

Beginning with this state of the art, it is an object of the invention of the instant application to provide a monitoring or control device for carbon brushes of drive units, especially for printing presses, which is automatic, continuous and absolutely free of wear, and by means of which the wear condition of the carbon brushes is signalled in a timely manner prior to reaching the wear limit, with the aim of avoiding any damage to the commutator and slip ring, respectively, so as to dispense with any necessity for immediately switching off the drive unit and so to enable replacement of the carbon brushes to be made ready beforehand while the drive unit is still operating.

With the foregoing and other objects in view, there has been provided, in accordance with the invention, a device for detecting the condition of a carbon brush in a drive unit, especially a drive unit of a printing press, comprising a non-contacting signalling device disposed in vicinity of a carbon brush yet out of contact with the carbon brush, preferably the brush subject to the greatest wear, and having means for monitoring the wear of the carbon brush, and means for triggering a warning signal when the carbon brush has reached a predetermined residual length.

Continuous, non-contacting monitoring of the carbon brushes makes it possible to detect their condition without expensive intermediate inspections and to provide the earliest possible signalling of the maximum permissible carbon brush wear with an analysis system requiring the simplest circuitry, while effectively eliminating any possibility of damage to the commutator and providing a sufficient time reserve for making-ready the replacement of the carbon brushes without having to shut down the machine because the drive unit has had to be stopped.

In accordance with another feature of the invention, the signalling device is of an opto electric type of construction, and the warning-signal triggering means includes a contactless light signal.

In order to ensure a clear isolation of the potential between the armature and the signalling circuits and, in accordance with a further feature of the invention, the signalling device is constructed as a lightguide optical system.

Because the light guides are not electrical conductors, they can therefore extend without any problem close to the carbon brushes which generally conduct a high electric voltage. In addition, they can be directly used for providing a light signal to the maintenance and operating personnel, respectively, so that no additional signalling facilities are necessary.

In accordance with an added feature of the invention, the carbon brush is received in a brush holder having a lateral wall formed with an opening therein, and the signalling device is disposed in the opening.

In accordance with an additional feature of the invention, the signalling device is of an opto-electric type of construction and includes an electrically generated light source, the drive unit comprising a motor having an internal voltage source connectible to the light source for supplying generating voltage thereto.

In accordance with yet another feature of the invention, the signalling device is constructed as a lightguide optical system, the carbon brush is received in a brush holder having a lateral wall formed with an opening wherein one end of the lightguide optical system is disposed opposite the carbon brush, and the internal voltage source of the motor comprises a field winding internal to the motor, the lightguide optical system including a first lightguide connected to the light source supplied by voltage via the field winding, and a second lightguide constructed as a reflex light probe extending to the surface of a housing of the motor. The lightguides permit, on the one hand, the remote application of the source of light from the carbon brush and, on the other hand, the extension of the reflex light source out of the motor housing at any location which is clearly visible from the outside.

To achieve a timely, clearly defined signal emission or output when the predetermined carbon-brush residual length is reached, in accordance with yet a further feature of the invention, the carbon brush has a surface facing towards the signalling device, and the brush holder has an inner surface, at least one of the surfaces being at least partly capable of furthering reflecting light.

In accordance with yet another feature of the invention, the one of the surfaces is at least partly colored.

In accordance with a concomitant feature of the invention, the warning signal is detectable by at least one of the senses of sight and hearing i.e. the warning signal is of an optical and/or acoustic type.

Other features which are considered as characteristic for the invention are set forth in the appended claims.

Although the invention is illustrated and described herein as embodied in a device for detecting the condition of carbon brushes, it is nevertheless not intended to be limited to the details shown, since various modifications and structural changes may be made therein without departing from the spirit of the invention and within the scope and range of equivalents of the claims.

Figure 2:
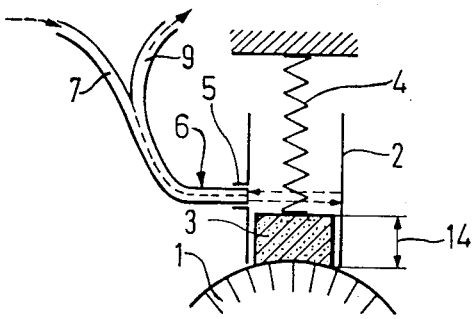

The construction and method of operation of the invention, however, together with additional objects and advantages thereof will be best understood from the following description of specific embodiments when read in connection with the accompanying drawings, in which:

FIG. 1 is a purely diagrammatic and schematic view of a signalling device according to the invention with a DC motor having a new carbon brush; and FIG. 2 is a fragmentary view of FIG. 1 showing a worn carbon brush at an instant at which a signal is given.

Referring now to the drawing and first, particularly, to FIG. 1 thereof, there is shown in a simplified form a carbon brush 3 guided on all sides in a carbon brush holder 2 and conventionally contacting, for example, a commutator 1 of a DC motor. The carbon brush 3 is pressed against the commutator 1 by a compression spring 4. The carbon brush holder 2 is provided on one side thereof with an opening 5 in which a non-contacting signalling device 6 of an opto-electric type of construction is arranged.

The signalling device 6 in the illustrated embodiment is an optical lightguide system having one lightguide 7 which is fed by a light source 8 and another lightguide 9 constructed as a reflex light probe which can be extended out of a housing 10 of the DC motor at any desired location at which it is clearly visible by operating personnel. The use of flexible fiber optics in this case is preferable. Alternatively or additionally, an acoustic warning device 11 can be provided on the motor housing 10. In order to be independent of an external power supply, the light source 8 is preferably energized by a voltage source 12 within the motor. For this purpose, the field winding of the motor which is thus being monitored is tapped, and a resistance 13 is connected ahead of the light source 8.

The operating principle of the aforedescribed signalling device 6 is explained in greater detail hereinafter.

The light source 8, which is energized by the exciting voltage of the field winding 12, transmits light into the one lightguide 7 of the lightguide optical signalling device 6. As long as the end of the lightguide optical signalling device 6 and its reflex light probe 9, respectively, are opposite the conventionally graphite-colored carbon brush 3, the light emitted by the light source 8 is relatively strongly absorbed by the surface of the carbon brush 3 so that no light can penetrate into the reflex light probe 9 extending to the surface of the motor housing 10. As carbon brush wear increases, the brush 3 becomes shorter and the upper end thereof, as viewed in FIG. 1, moves towards the commutator 1.

The instant, however, that the carbon 3 has been worn down or consumed to a predetermined residual length 14, represented by a double-headed arrow in FIG. 2 and established for practical purposes as being slightly greater in length than for the absolute wear limit at which the drive unit is required to be forcibly switched off to avoid any irreparable damage, the carbon brush 3 assumes the position thereof shown in FIG. 2 below the opening 5 in the carbon brush holder 2. The light generated by the light source 8 is then able to penetrate into the interior of the carbon brush holder 2 above the consumed carbon brush 3 and is reflected therein onto the inner opposite side of the carbon brush holder 2.

To improve the reflection of the light rays transmitted by the lightguide optical device, the inner side of the carbon brush holder 2 which reflects the light rays can be constructed so as to be capable of promoting the advancement of reflex light, preferably by having a bright or light color.

The reflected light is transmitted via the reflex light probe line 9 to the surface of the motor housing 10 so that a bright spot of light appears on the reflex light probe 9 projecting at that location. Naturally, it is possible to intensify or amplify the light signal and alternatively or additionally, respectively, to convert it into an acoustic warning signal 14 so as to be able thereby to signal the maintenance personnel.

As noted hereinbefore, the invention is, naturally, not limited to the embodiment shown in the two figures and described in the foregoing specification. It is believed to be readily apparent that numerous structural variations and further developments are also included within the framework of the invention. It is perfectly conceivable, for example, to use a simple shaped part formed of optical plexiglass in place of the optical lightguide; in either case, the evaluation circuit is independent of the potential of the mains or power supply network. It is likewise possible to provide, in place of the reflex light probe 9 in the opening 5, only an opto-electronic transmitter and, in another non-illustrated opening on the opposite side of the carbon brush holder 2, an appertaining opto-electronic receiver, e.g. a photo-electric diode. In addition, the scope of the invention also includes the supply of power to the light source 8 from a power source external to the motor.

We claim:

1. Device for detecting a condition of a carbon brush in a drive unit comprising a signalling device constructed as a lightguide optical system and disposed in vicinity of a carbon brush yet out of contact with the carbon brush and having means for monitoring wear of the carbon brush, said wear-monitoring means including a first lightguide for transmitting light to the carbon brush, and a second lightguide for transmitting light reflected form the carbon brush when the carbon brush has reached a predetermined residual length, the carbon brush being received in a brush holder and having a surface facing towards said signalling device, and said brush holder having an inner surface, at least one of said surfaces being at least partly capable of reflecting, to said second light guide so as to be optically visible at said second lightguide, the light which is transmitted to said one surface through said first lightguide.

2. Device according to claim 1, wherein said brush holder has a lateral wall formed with an opening therein, and said signalling device is disposed in said opening.

3. Device according to claim 1, wherein said signalling device includes an electrically generated light source, the drive unit comprising a motor having an internal voltage source connectible to said light source for supplying generating voltage thereto.

4. Device according to claim 1 wherein said one of said surfaces is at least partly colored.

5. Device for detecting a condition of a carbon brush in a drive unit comprising a signalling device constructed as a lightguide optical system and disposed in vicinity of a carbon brush yet out of contact with the carbon brush and having means for monitoring wear of the carbon brush, and means connected to said monitoring means for triggering a warning signal when the carbon brush has reached a predetermined residual length, said signalling device including an electrically generated light source, the drive unit comprising a motor having an internal voltage source connectible to said light source for supplying generating voltage thereto, the carbon brush being received in a brush holder having a lateral wall formed with an opening wherein one end of said lightguide optical system is disposed opposite the carbon brush, and said internal voltage source of said motor comprising a field winding internal to said motor, said lightguide optical system including a first lightguide connected to said light source supplied by voltage via said field winding, and a second lightguide constructed as a reflex light probe extending to the surface of a housing of said motor.

6. Device according to claim 5, wherein said warning signal of detectable by at least one of the senses of sight and hearing.

* * * * *